US012135175B2

(12) United States Patent
Schwedler

(10) Patent No.: US 12,135,175 B2
(45) Date of Patent: Nov. 5, 2024

(54) FLUID CONTROL FOR A VARIABLE FLOW FLUID CIRCUIT IN AN HVACR SYSTEM

(71) Applicant: TRANE INTERNATIONAL INC., Davidson, NC (US)

(72) Inventor: Michael C. A. Schwedler, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 18/338,063

(22) Filed: Jun. 20, 2023

(65) Prior Publication Data

US 2023/0332850 A1 Oct. 19, 2023

Related U.S. Application Data

(63) Continuation of application No. 16/233,949, filed on Dec. 27, 2018, now abandoned.

(51) Int. Cl.
*F28F 27/02* (2006.01)

(52) U.S. Cl.
CPC ..... *F28F 27/02* (2013.01); *F28F 2250/06* (2013.01)

(58) Field of Classification Search
CPC .... F28F 2250/06; F28F 2250/08; F28F 27/02; F24F 1/00077; F24F 11/84; F24F 11/85; F25B 5/02; F25B 41/04; F25B 2313/0232; F25B 2313/0253; F25B 2400/0409; F25B 2400/075; F25B 2600/2501; F25B 2600/2515; F25B 2700/13
See application file for complete search history.

(56) References Cited

U.S. PATENT DOCUMENTS

| | | | |
|---|---|---|---|
| 5,743,102 | A | 4/1998 | Thomas |
| 5,946,926 | A | 9/1999 | Hartman |
| 6,666,042 | B1 | 12/2003 | Cline |
| 6,792,765 | B2 | 9/2004 | Domnick |
| 7,028,768 | B2 | 4/2006 | Aler |
| 8,275,483 | B2 | 9/2012 | Higgins |
| 8,939,196 | B2 | 1/2015 | Morita |
| 9,759,457 | B1 | 9/2017 | Gillooly |
| 2004/0000155 | A1 | 1/2004 | Cline et al. |
| 2006/0010893 | A1 | 1/2006 | Dominguez |
| 2012/0000241 | A1 | 1/2012 | Furlan |

(Continued)

OTHER PUBLICATIONS

Schwedler et al., "Variable Primary Flow Systems", HPAC—Heating/Piping/AirConditioning, pp. 41-44, Apr. 2000.

(Continued)

*Primary Examiner* — Travis Ruby
(74) *Attorney, Agent, or Firm* — HSML P.C.

(57) ABSTRACT

A method of controlling an HVACR unit in an HVACR system including an HVACR unit through which a process fluid is pumped to meet a temperature control demand includes monitoring, by a controller, a flowrate of the process fluid through the HVACR unit. When the flowrate of the process fluid is above a minimum flowrate threshold, the process fluid is provided to one or more terminals in the HVACR system according to the temperature control demand. A bypass flow of the process fluid through a bypass line is disabled by changing a state of a valve fluidly connected to the bypass line and one of the one or more terminals to a flow disabled state. When the flowrate of the process fluid is below the minimum flowrate threshold, the controller enables the bypass flow of the process fluid through the bypass line.

9 Claims, 5 Drawing Sheets

(56) References Cited

U.S. PATENT DOCUMENTS

| | | | |
|---|---|---|---|
| 2012/0006050 | A1 | 1/2012 | Takayama et al. |
| 2012/0255319 | A1 | 10/2012 | Itoh et al. |
| 2013/0048114 | A1 | 2/2013 | Rothman et al. |
| 2013/0186126 | A1 | 7/2013 | Morimoto et al. |
| 2013/0219937 | A1 | 8/2013 | Motomura et al. |
| 2014/0008033 | A1 | 1/2014 | Howes et al. |
| 2014/0097367 | A1 | 4/2014 | Burt et al. |
| 2014/0318170 | A1 | 10/2014 | Katoh |
| 2015/0377509 | A1 | 12/2015 | Nicolai |
| 2017/0021698 | A1 | 1/2017 | Hatakeyama et al. |
| 2017/0176032 | A1 | 6/2017 | Wang et al. |
| 2017/0342864 | A1 | 11/2017 | Bergweiler |
| 2017/0349030 | A1 | 12/2017 | Miura et al. |
| 2018/0023867 | A1 | 1/2018 | Douven et al. |
| 2018/0045446 | A1 | 2/2018 | Beier |
| 2018/0356108 | A1 | 12/2018 | Eiermann |

OTHER PUBLICATIONS

Villani, "Chilled Water System Commissioning: Variable Primary Flow", 18th National Conference on Building Commissioning, A PECI Event, (40 pages) 2010.

Taylor, "Primary-Only vs. Primary-Secondary Variable Flow Systems", ASHRAE Journal, pp. 25-29, Feb. 2002.

Extended European Search Report, European Patent Application No. 19216639.5, May 29, 2020 (8 pages).

FLUID CONTROL FOR A VARIABLE FLOW FLUID CIRCUIT IN AN HVACR SYSTEM

FIELD

This disclosure relates generally to a heating, ventilation, air conditioning, and refrigeration (HVACR) system. More specifically, this disclosure relates to flow control of a process fluid in a fluid circuit of an HVACR system.

BACKGROUND

A heating, ventilation, air conditioning, and refrigeration (HVACR) system can include a refrigerant circuit having a compressor, a condenser, an expansion valve, and an evaporator fluidly connected. A fluid circuit having a temperature controlled fluid can be included in the HVACR system. The HVACR system can include a chiller, a boiler, or the like. The fluid circuit can include a process fluid (e.g., water, glycol, air, or the like) circulated in a heat exchange relationship with the refrigerant circuit. The chiller, boiler, or the like can remove heat from the process fluid via a refrigeration cycle (e.g., a vapor compression cycle). The chiller, boiler, or the like can be configured to cool or heat the process fluid to a specific temperature set point(s) based on, for example, a primary function of the process fluid.

SUMMARY

This disclosure relates generally to a heating, ventilation, air conditioning, and refrigeration (HVACR) system. More specifically, this disclosure relates to flow control of a process fluid in a fluid circuit of an HVACR system.

A fluid circuit for an HVACR unit is disclosed. In an embodiment, the HVACR unit is a chiller. In an embodiment, the HVACR unit is a boiler. The HVACR unit includes a fluid circuit circulating a process fluid.

A method of controlling an HVACR unit in a heating, ventilation, air conditioning, and refrigeration (HVACR) system that includes an HVACR unit through which a process fluid can be pumped to meet a temperature control demand is disclosed. The method includes monitoring, by a controller, a flowrate of the process fluid through the HVACR unit. In response to the monitoring, when the flowrate of the process fluid is greater than a minimum flowrate threshold, the process fluid is provided to one or more terminals in the HVACR system via the first HVACR unit according to the temperature control demand, and a bypass flow of the process fluid through a bypass line is disabled by changing a state of a valve fluidly connected to the bypass line and one of the one or more terminals to a flow disabled state. When the flowrate of the process fluid is below the minimum flowrate threshold, the controller enables the bypass flow of the process fluid through the bypass line by changing the state of the valve fluidly connected to the bypass line and the one of the one or more terminals to a flow enabled state.

A fluid circuit for an HVACR system is also disclosed. The system includes an HVACR unit; a variable flowrate pump; and a plurality of terminals. At least one of the plurality of terminals includes a bypass line. A portion of a fluid in the fluid circuit that flows through the bypass line bypasses the one of the plurality of terminals. The at least one of the plurality of terminals including the bypass line has a valve fluidly connected to the one of the plurality of terminals and fluidly connected to the bypass line. A flow control state of the fluid through the bypass line is selectively controlled to maintain a minimum flowrate of the process fluid through the HVACR unit. A controller is configured to monitor a flowrate of the process fluid in the fluid circuit and to control the flow control state of the bypass line.

A fluid circuit for circulating a process fluid in an HVACR system is also disclosed. The system includes a plurality of HVACR units including a first HVACR unit having a first minimum flowrate threshold; and a second HVACR unit having a second minimum flowrate threshold. A first variable flowrate pump and a second variable flowrate pump are included. A plurality of terminals provide temperature control to a conditioned space within the HVACR system. At least one of the plurality of terminals includes a bypass line. A portion of the process fluid in the fluid circuit flowing through the bypass line bypasses the at least one of the plurality of terminals. The at least one of the plurality of terminals including the bypass line has a valve fluidly connected to the one of the plurality of terminals and fluidly connected to the bypass line. A flow control state of the fluid through the bypass line is selectively controlled to maintain a minimum flowrate of the process fluid through the first HVACR unit and the second HVACR unit. A controller is configured to monitor a flowrate of the process fluid in the fluid circuit and to control the flow control state of the bypass line.

BRIEF DESCRIPTION OF THE DRAWINGS

References are made to the accompanying drawings that form a part of this disclosure, and which illustrate embodiments in which systems and methods described in this Specification can be practiced.

Like reference numbers represent like parts throughout.

DETAILED DESCRIPTION

Figure 1:
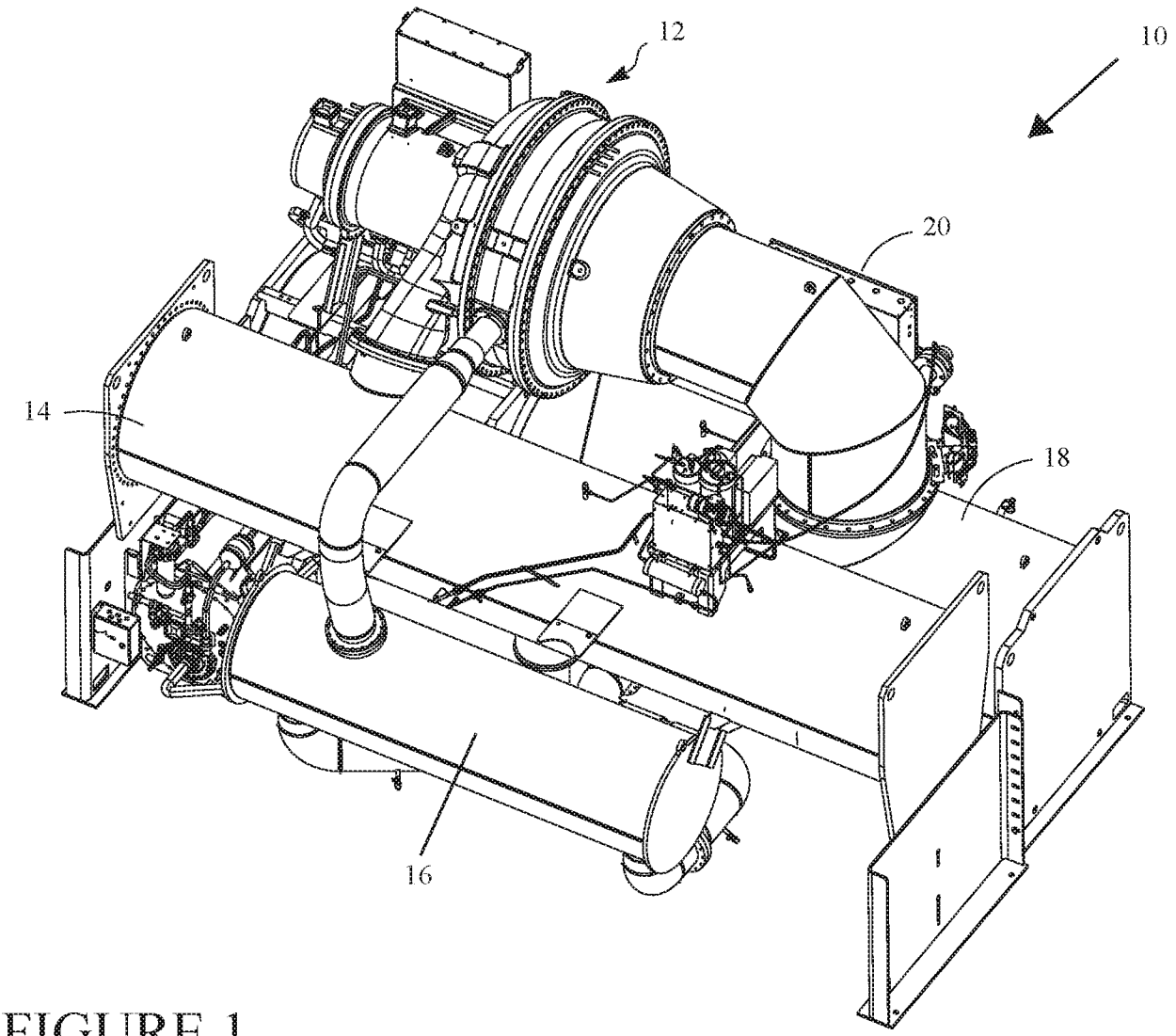
FIG. 1 is a perspective view of a chiller of a heating, ventilation, air conditioning, and refrigeration (HVACR) system, according to an embodiment.

This disclosure relates generally to a heating, ventilation, air conditioning, and refrigeration (HVACR) system. More specifically, this disclosure relates to flow control of a process fluid in a fluid circuit of an HVACR system.

An HVACR unit, such as, but not limited to a chiller or a boiler, can generally be used in an HVACR system to remove heat from a process fluid (e.g., water, glycol, air, suitable combinations thereof, or the like) via a refrigeration cycle (e.g., a vapor compression cycle) or to add heat to the process fluid. The HVACR unit can be configured to cool or heat the process fluid to a specific temperature set point(s) based on, for example, a primary function of the process fluid. The HVACR system can include a single HVACR unit. In some HVACR systems, a plurality of HVACR units can be included. When multiple HVACR units are included in the HVACR system, the HVACR units may have different rated capacities. That is, in an HVACR system with multiple HVACR units, the HVACR units can be sized differently. The particular configuration may be based on, for example, a building size, heating or cooling requirements, or the like.

An HVACR unit may include a refrigerant circuit (see FIG. 2 and its corresponding description below). In an embodiment, a chiller includes a refrigerant circuit. In an embodiment, a plurality of chillers can be connected for example in parallel. In an embodiment, a boiler(s) can heat the process fluid via a heat exchange relationship, e.g., with a gas or other combustible fluid heating the process fluid when combusted.

In operation, the process fluid can have a variable flowrate through the fluid circuit of the HVACR system. During certain operating conditions, for example, when there is a low cooling load or a low heating load, the process fluid may be circulated at a lower fluid flowrate due to a decreased demand. A low cooling load may occur, for example, when the ambient temperature is relatively cooler so that less cooling is required in various conditioned spaces of a building. A low heating load may occur, for example, when the ambient temperature is relatively warmer so that less heating is required in various conditioned spaces of a building.

In low load operating conditions, the fluid flowrate of the process fluid through the HVACR unit may decrease below a minimum acceptable flowrate for the HVACR unit. The minimum acceptable flowrate can be based on, for example, requirements established by the manufacturer of the HVACR unit or the like. In some cases, a building operator can establish a minimum acceptable flowrate. For example, the building operator may provide a minimum acceptable flowrate that is aimed at, for example, reducing possibility of sediment accumulating in the fluid circuit. Embodiments of this disclosure include a valve (e.g., three-way valve) and bypass line installed within the fluid circuit that can be controlled to manage the flowrate of the process fluid and maintain the flowrate above the minimum acceptable flowrate.

FIG. 1 is a perspective view of a chiller 10 of an HVACR system, according to an embodiment. The chiller 10 is an example system in which embodiments and methods described in this Specification can be practiced. It will be appreciated that aspects of the chiller 10 may be modified within the scope of embodiments described in this Specification.

The chiller 10 includes, among other features, a compressor 12 fluidly connected to a condenser 14, which is fluidly connected to an economizer 16, and an evaporator 18. In an embodiment, the economizer 16 can be optional. The fluidly connected components, for example, may form a refrigerant circuit (e.g., refrigerant circuit 50 shown and described in additional detail in accordance with FIG. 2 below).

In the illustrated embodiment, the chiller 10 is a water-cooled chiller. In an embodiment, the chiller 10 can alternatively be an air-cooled chiller or the like.

In an embodiment, a fluid used in the refrigerant circuit (e.g., a working fluid) can be a heat transfer fluid or medium such as a refrigerant or the like which is in a heat exchange relationship with one or more heat transfer fluids or media (e.g., a process fluid) such as, but not limited to, water, glycol, air, suitable combinations thereof, or the like, to cool or chill the process fluid for other use or applications such as, but not limited to, a comfort cooling application, an industrial cooling process application, a commercial cooling process application, or the like.

A control system 20 may control an operation of the chiller 10. It will be appreciated that the chiller 10 and/or the refrigerant circuit for the chiller 10 can include one or more additional features.

Figure 2:
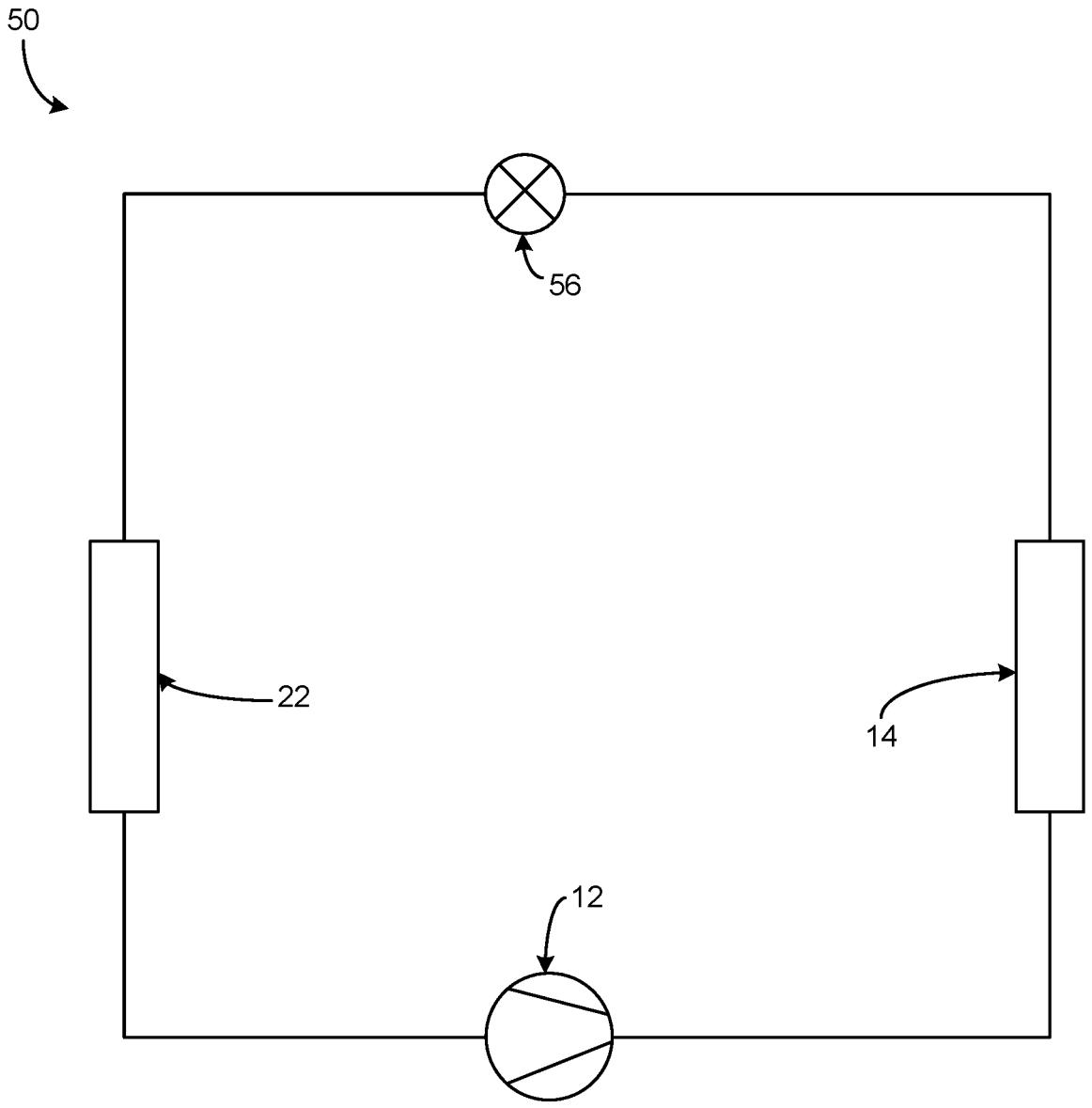
FIG. 2 is a schematic diagram of a refrigerant circuit, according to an embodiment.

FIG. 2 is a schematic diagram of a refrigerant circuit 50, according to an embodiment. The refrigerant circuit 50 is generally representative of a refrigerant circuit that can be used in the chiller 10 in FIG. 1.

The refrigerant circuit 50 generally includes the compressor 12, the condenser 14, an expansion device 56 (e.g. valve, orifice, expander, or the like), and an evaporator 22. The refrigerant circuit 50 is an example and can be modified to include additional components. For example, in an embodiment, the refrigerant circuit 50 can include other components such as, but not limited to, an economizer heat exchanger (e.g., the economizer 16 in FIG. 1), one or more flow control devices (e.g., a valve or the like), a receiver tank, a dryer, a suction-liquid heat exchanger, or the like.

The refrigerant circuit 50 can generally be applied in a variety of systems used to control an environmental condition (e.g., temperature, humidity, air quality, or the like) in a space (generally referred to as a conditioned space). In an embodiment, the refrigerant circuit 50 can be applied to control the environmental condition to cool an industrial or commercial process load. Examples of such systems include, but are not limited to, HVACR systems or the like.

The compressor 12, condenser 14, expansion device 56, and evaporator 22 are fluidly connected.

The refrigerant circuit 50 can operate according to generally known principles. The refrigerant circuit 50 can be configured to heat or cool a liquid process fluid (e.g., a heat transfer fluid or medium such as, but not limited to, water, glycol, combinations thereof, or the like), in which case the refrigerant circuit 50 may be generally representative of a liquid chiller system. For example, the refrigerant circuit 50 may be implemented in the chiller 10 shown and described above in accordance with FIG. 1 above. Furthermore, the refrigerant circuit 50 and corresponding chiller (e.g., chiller 10) can be connected in parallel to condition the process fluid.

In operation, the compressor 12 compresses a working fluid (e.g., a heat transfer fluid such as a refrigerant or the like) from a relatively lower pressure gas to a relatively higher-pressure gas. The relatively higher-pressure gas is also at a relatively higher temperature, which is discharged from the compressor 12 and flows through the condenser 14. The working fluid flows through the condenser 50 and rejects heat to a process fluid (e.g., water, glycol, combinations thereof, or the like), thereby cooling the working fluid.

The cooled working fluid, which is now in a liquid form, flows to the expansion device 56. The expansion device 56 reduces the pressure of the working fluid. As a result, a portion of the working fluid is converted to a gaseous form. The working fluid, which is now in a mixed liquid and gaseous form flows to the evaporator 22. The working fluid flows through the evaporator 22 and absorbs heat from a process fluid (e.g., water, glycol, combinations thereof, or the like), heating the working fluid, and converting it to a gaseous form. The gaseous working fluid then returns to the compressor 12. The above-described process continues while the refrigerant circuit is operating, for example, in a cooling mode (e.g., while the compressor 12 is enabled).

Figure 3A:
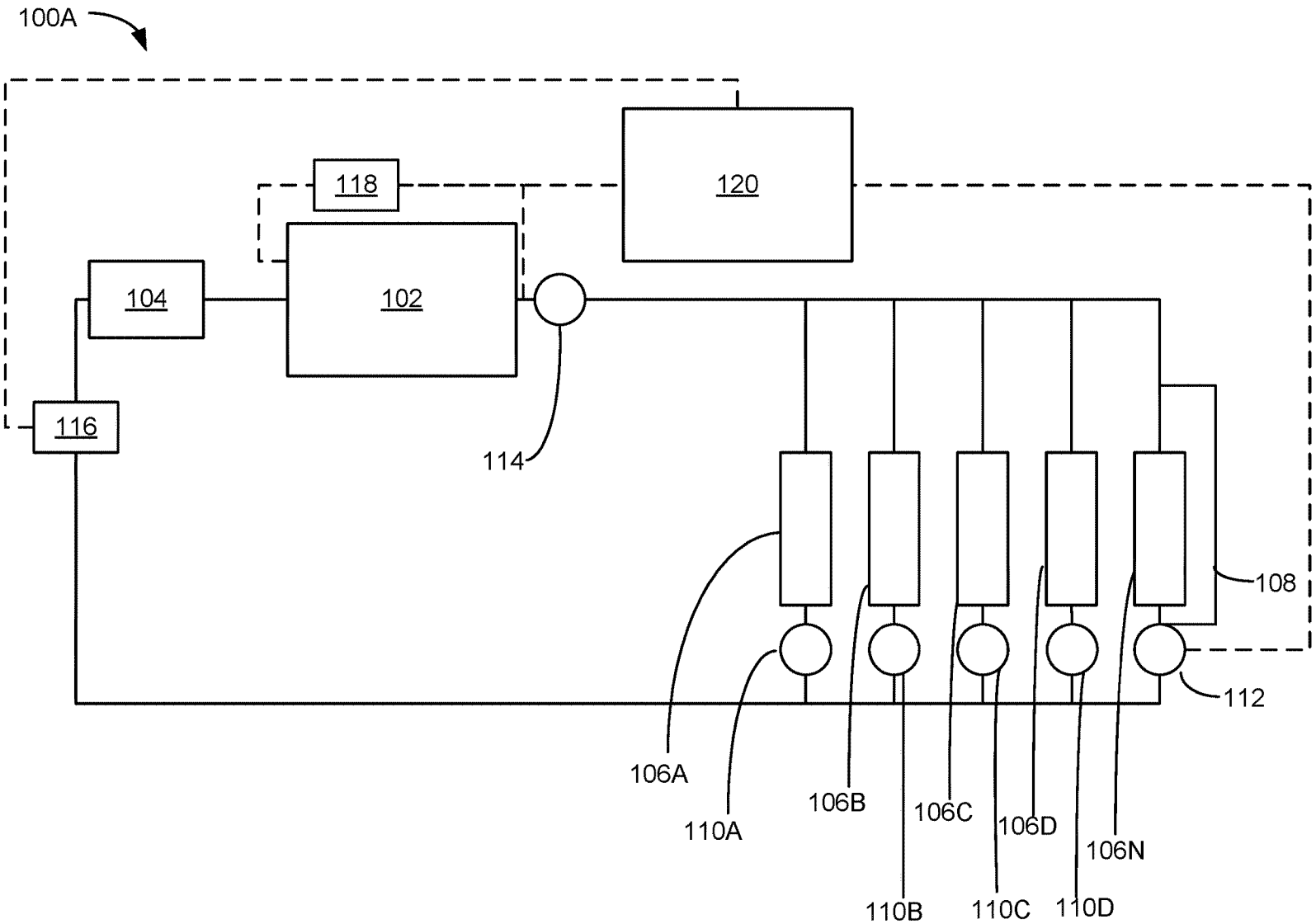
FIG. 3A is a schematic diagram of a fluid circuit, according to an embodiment.

FIG. 3A is a schematic diagram of a fluid circuit 100A, according to an embodiment. The fluid circuit 100A can alternatively be referred to as the process fluid circuit 100A. In an embodiment, the fluid circuit 100A can alternatively be referred to as the conditioned water circuit 100A, the chilled water circuit 100A, the heated water circuit 100A, or the like. The fluid circuit 100A is representative of a process fluid circuit in an HVACR system for controlling a climate in one or more conditioned spaces in a building, for heating or cooling a commercial or industrial process load, suitable combinations thereof, or the like. During operation, there may be minimum flowrates required for the fluid circuit 100A.

The fluid circuit 100A generally includes an HVACR unit 102; a pump 104; a plurality of terminals 106A-106N; a bypass line 108; a plurality of valves 110A-110D; a valve 112; a valve 114; a flowmeter 116; a differential pressure sensor 118; and a controller 120.

In an embodiment, the HVACR unit 102 can be a chiller such as, but not limited to, the chiller 10 in FIG. 1. In an embodiment, the HVACR unit 102 can be a boiler utilizing a combustible fluid (e.g., natural gas or the like) as a working fluid for heating a process fluid when the working fluid is combusted.

The HVACR unit 102 can include a refrigerant circuit (not shown in FIG. 3A; e.g., the refrigerant circuit 50 discussed in accordance with FIG. 2 above). It is to be appreciated that more than one HVACR unit 102 (e.g., see fluid circuit 100B in FIG. 3B) can be present in the fluid circuit 100A.

The HVACR unit 102 is not intended to be limited to a particular design. The HVACR unit 102 can include a refrigerant circuit (not shown) configured to exchange heat with the process fluid (e.g., water, glycol, suitable combinations thereof, or the like).

The number of HVACR units 102 in the fluid circuit 100A can be based on, for example, design requirements for a building in which the fluid circuit 100A is implemented.

The HVACR unit 102 may have minimum flowrate. The minimum flowrate can be, for example, a manufacturer's recommended minimum flowrate of the process fluid, a building operator preference, or the like. In an embodiment, the minimum flowrate can be representative of a flowrate of the process fluid through an evaporator or a condenser of the HVACR unit 102 that ensures effective heat transfer and that a fluid temperature leaving the HVACR unit 102 can be maintained, and can also prevent problems in the heat exchanger (e.g., fouling of the tubes or the like).

Pump 104 can be used to circulate the process fluid throughout the fluid circuit 100A. Pump 104 is representative of a variable flowrate pump. As such, the pump 104 can be operated to provide a variable flowrate to the process fluid circulating throughout the fluid circuit 100A. It is to be appreciated that there can be more than one pump 104 included in the fluid circuit 100A.

In the illustrated embodiment, five terminals 106A-106N are shown. A terminal as used in this Specification can include any heat transfer device and control valve combination and is not intended to be limited to a particular structure. It will be appreciated that the number of terminals 106A-106N is illustrative and can vary based on, for example, a building in which the HVACR system is implemented. The terminals 106A-106N can include radiant cooling (e.g., panels or tubing which can be embedded into a building structure); chilled beams (e.g., active or passive); fan-powered terminals (e.g., fan-coils, fan-powered variable air volume (VAV) terminals with sensible cooling coils, or the like); air handlers; process cooling load terminals; heat exchange coils in an airstream; dedicated outdoor HVACR units; as well as suitable combinations thereof.

The terminals 106A-106D include a valve 110A-110D. At least one of the terminals 106A-106N includes a bypass line 108. In the illustrated embodiment, the bypass line 108 is illustrated at the terminal 106N. The bypass line 108 enables a portion of the process fluid to bypass the terminal 106N when the bypass flow is enabled. Accordingly, fluid connections of the bypass line 108 are both upstream of the terminal 106N and downstream of the terminal 106N. For example, an inlet of the bypass line 108 is upstream of the terminal 106N and an outlet of the bypass line 108 is downstream of the terminal 106N.

It is to be appreciated that a plurality of the terminals 106A-106N can include bypass line 108. That is, more than one bypass line 108 can be included in the fluid circuit 100A. Any terminal such as the terminal 106N which has the bypass line 108 includes the valve 112 instead of the valve 110A-110D. The particular terminal 106A-106N that is selected to include the bypass line 108 can be selected so that temperature controlled fluid is provided to a majority of the terminals 106A-106N even when the bypass line 108 is in a flow enabled state. In an embodiment, the location of the bypass line 108 can be selected based on, for example, an ease of installing the bypass line 108 or the like.

The terminals 106A-106D and the corresponding valves 110A-110D are selectively actuatable to control a flow of process fluid through the corresponding terminal 106A-106D. The valves 110A-110D can have two states, a flow enabled state and a flow disabled state.

In operation, when the terminals 106A-106D require cooling, the corresponding valves 110A-110D can be in the flow enabled state so that the temperature controlled process fluid flows through a heat exchange relationship with the corresponding terminals 106A-106D. When the terminals 106A-106D do not require cooling, the corresponding valves 110A-110D can be in the flow disabled state so that the temperature controlled process fluid does not flow in a heat exchange relationship with the corresponding terminals 106A-106D. It is to be appreciated that the terminals 106A-106D and the corresponding valves 110A-110D are separately controllable. In an embodiment, the valves 110A-110D can be modulating valves having a flow enabled state, a flow disabled state, and at least one partial flow state.

At the location of the bypass line 108, the valve 112 is included. In the illustrated embodiment, the valve 112 is a three-way valve. In an embodiment, two separate valves may be used in place of the valve 112, though that may increase a complexity of the system. The valve 112 includes fluid connections for the bypass line 108 and the primary fluid flow through the terminal 106N. In an embodiment, a default state of the valve 112 is such that flow through the bypass line 108 is disabled. That is, the valve 112 can be set so that it is generally fluidly closed to bypass line 108.

When flow through the bypass line 108 is enabled via the valve 112, a portion of the fluid may still flow through the terminal 106N, depending upon a state of the valve 112 with respect to the terminal 106N. That is, the flow through the terminal 106N may be controllable by the valve 112 even when the flow through the bypass line 108 is enabled. In this manner, even when flow of the process fluid through the bypass line 108 is enabled, cooling demands in the conditioned space may still be met via the terminal 106N.

The valve 112 is selectively modifiable based on an operating condition (e.g., a flowrate of the process fluid, a cooling requirement, combinations thereof, or the like). For example, the valve 112 can be selectively enabled or disabled so that process fluid is selectively provided to the terminal 106N according to a cooling requirement. The valve 112 can also be selectively enabled or disabled so that the process fluid selectively bypasses the terminal 106N via the bypass line 108. In an embodiment in which the valve 112 enables flow through the bypass line 108, the flow can be enabled through the terminal 106N as well as through the bypass line 108.

In an embodiment, the valve 112 and bypass line 108 can be included on one or more of the remaining terminals 106A-106D. In such an embodiment, the corresponding valve 110A—110D would be replaced with the valve 112. In the illustrated embodiment, the valves 110A-110D and the valve 112 are disposed on a downstream side of the terminals 106A-106N. It is to be appreciated that the valves 110A-110D and the valve 112 can alternatively be placed on an upstream side of the terminals 106A-106N, according to an embodiment.

In an embodiment, the bypass line 108 may need to be added to the fluid circuit 100A. That is, the bypass line 108 can be retrofit into an existing fluid circuit to provide the capability of maintaining the flowrate of the process fluid above the minimum flowrate threshold. In an embodiment, the bypass line 108 and a valve may be present in the fluid circuit 100A when completing the retrofitting of the fluid circuit 100A. However, in such embodiments, the valve may need to be replaced with the valve 112 as described in this Specification.

The HVACR unit 102 includes valve 114. The valve 114 can be selectively controlled to enable or disable fluid flow from the HVACR unit 102. In an embodiment, this control can be based on a cooling load requirement, an operating state of the HVACR unit 102, or the like.

The fluid circuit 100A can optionally include a sensor 116 for monitoring a flowrate of the fluid in the fluid circuit 100A. In an embodiment, the sensor 116 is a flowmeter.

In an embodiment, the sensor 116 is optional and may not be included in the fluid circuit 100A. In such an embodiment, an alternative way to determine a flowrate of the process fluid can use differential pressure sensor 118.

It is to be appreciated that the sensor 116 and/or the differential pressure sensor 118 can be included to determine the flowrate of the process fluid. Accordingly, when the sensor 116 is present, the differential pressure sensor 118 may not be present in an embodiment. Alternatively, when the differential pressure sensor 118 is present, the sensor 116 may not be present in an embodiment.

The sensor 116 and/or the differential pressure sensor 118 is electrically connected to the controller 120. The valve 112 is also electrically connected to the controller 120.

In operation, the controller 120 can receive values from the sensor 116 and/or the differential pressure sensor 118. The controller 120 can selectively control a state (e.g., flow enabled, flow disabled, partial flow, or the like) of the valve 112 based on the values received. In an embodiment, the differential pressure sensor 118 can be integral to the HVACR unit 102. In an embodiment, the differential pressure sensor 118 may be separate from the HVACR unit 102.

For example, when the sensor 116 is included in the fluid circuit 100A, the controller 120 can determine whether the flowrate as received from the sensor 116 is below a minimum flowrate threshold and take action by enabling the bypass flow through bypass line 108 when the flowrate is below the minimum flowrate threshold.

In an embodiment in which the sensor 116 is not included, the controller 120 can utilize the differential pressure received from the differential pressure sensor 118 to calculate a corresponding flowrate. Then, if the flowrate determined is below the minimum flowrate threshold, the controller 120 can take action by enabling the bypass flow through bypass line 108 when the flowrate is below the minimum flowrate threshold. That is, if the flowrate of the HVACR unit 102 is below the minimum flowrate threshold, then flow through the bypass line 108 can be enabled.

The controller 120 can be representative of the controller 20 for the chiller unit 10 (FIG. 1). In an embodiment, the controller 120 can be any controller within the HVACR system such as, but not limited to, the chiller controller 20, a controller for a building automation system for the HVACR system, a unit controller corresponding to the terminals 106A-106N, or the like. The controller 120 can be any controller within the HVACR system that is electrically connected to the HVACR unit 102; is electrically connected to the sensor 116 and/or the differential pressure sensor 118; and that is electrically connected to the valve 112.

Figure 3B:
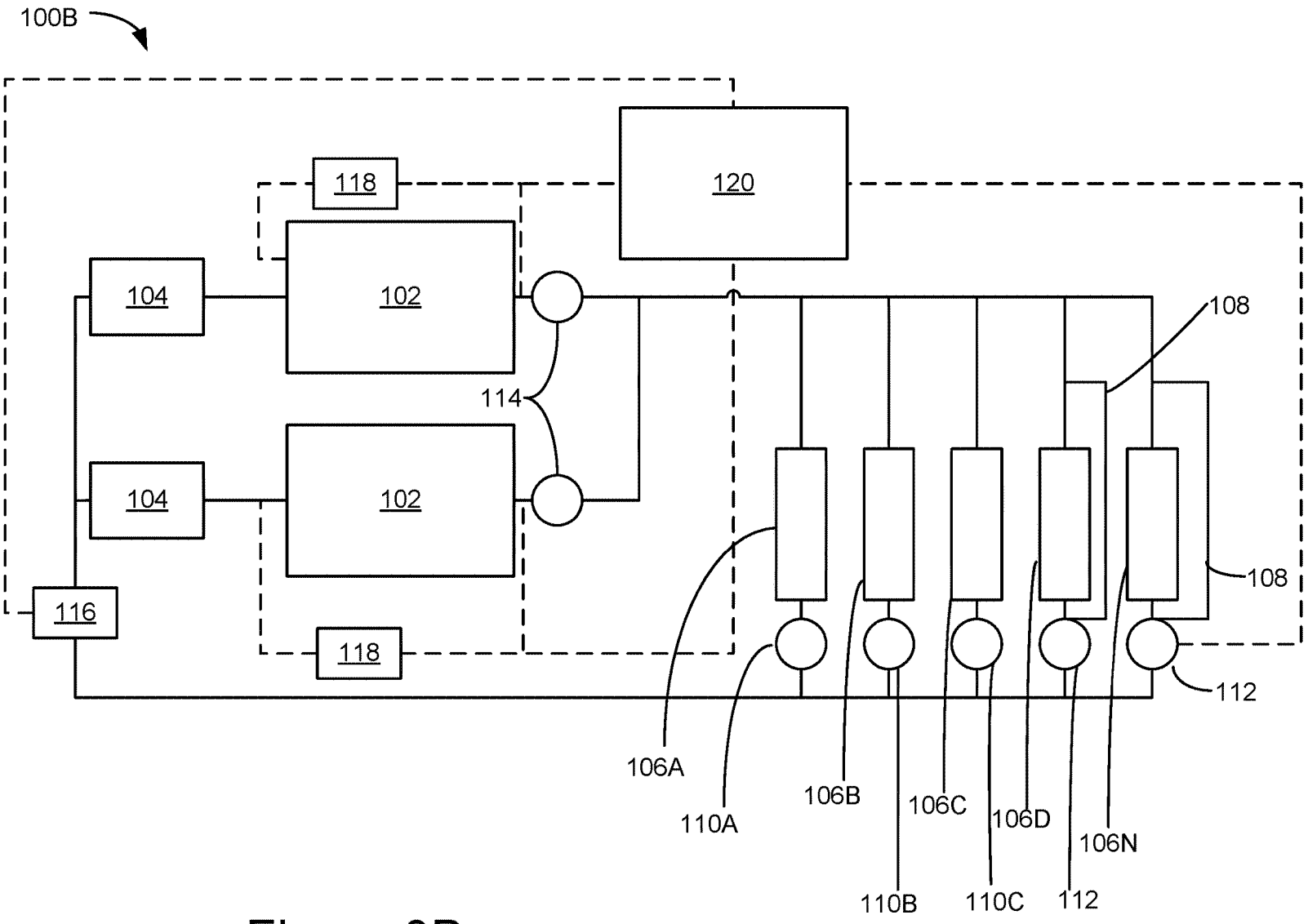
FIG. 3B is a schematic diagram of a fluid circuit, according to another embodiment.

FIG. 3B is a schematic diagram of a fluid circuit 100B, according to an embodiment. The fluid circuit 100B can alternatively be referred to as the process fluid circuit 100B. In an embodiment, the fluid circuit 100B can alternatively be referred to as the conditioned water circuit 100B, the chilled water circuit 100B, the heated water circuit 100B, or the like. The fluid circuit 100B is representative of a process fluid circuit in an HVACR system for controlling a climate in one or more conditioned spaces in a building, for heating or cooling a commercial or industrial process load, suitable combinations thereof, or the like. During operation, there may be minimum flowrates required for the fluid circuit 100B.

The fluid circuit 100B generally differs from the fluid circuit 100A (FIG. 3A) in that there are a plurality of HVACR units 102 included in the fluid circuit 100B. Further, the terminal 106D includes a second bypass line 108 and valve 112. It is to be noted that a number of bypass lines 108 does not necessarily correspond to a number of HVACR units 102. For example, depending upon the minimum flowrate threshold for a fluid circuit, the number of bypass lines 108 may be selected. Accordingly, in the illustrated embodiment, less than two bypass lines 108 may be sufficient, or more than two bypass lines 108 may be included to meet a minimum flow requirement.

In the illustrated embodiment, the fluid circuit 100B generally includes two HVACR units 102; two pumps 104; a plurality of terminals 106A-106N; bypass lines 108; a plurality of valves 110A-110D; valves 112; a plurality of valves 114; a flowmeter 116; a plurality of differential pressure sensors 118; and a controller 120.

Each HVACR unit 102 can include a refrigerant circuit (not shown in FIG. 3B; e.g., the refrigerant circuit 50 discussed in accordance with FIG. 2 above). In the illustrated embodiment, two HVACR units 102 are shown. It is to be appreciated that the number of HVACR units 102 is representative and can vary beyond two.

The HVACR units 102 are not intended to be limited to a particular design. The HVACR unit 102 can include a refrigerant circuit (not shown) configured to output the process fluid (e.g., water, glycol, suitable combinations thereof, or the like).

The number of HVACR units 102 can be based on, for example, design requirements for a building in which the fluid circuit 100B is implemented. In an embodiment, the HVACR units 102 can be the same (e.g., same design capacity or the like). In an embodiment, the HVACR units 102 can be different. For example, one of the HVACR units 102 can have a relatively higher rated capacity than the other of the HVACR units 102.

The HVACR units 102 may have a minimum flowrate. The minimum flowrate can be, for example, a manufacturer's recommended minimum flowrate of the process fluid a building operator preference, or the like. The minimum flowrate can be representative of a flowrate of the process fluid through an evaporator or a condenser of the HVACR unit 102 that ensures effective heat transfer and that a fluid temperature leaving the HVACR unit 102 can be maintained, and can also prevent problems in the heat exchanger (e.g., fouling of the tubes or the like).

Pumps 104 can be used to circulate the process fluid throughout the fluid circuit 100B. Pumps 104 are representative of variable flowrate pumps. As such, the pumps 104 can be operated to provide a variable flowrate to the process fluid throughout the fluid circuit 100B. In an embodiment, more than two pumps 104 can be included in the fluid circuit 100B.

In the illustrated embodiment, five terminals 106A-106N are shown. A terminal as used in this Specification can include any heat transfer device and control valve combination and is not intended to be limited to a particular structure. It will be appreciated that the number of terminals 106A-106N is illustrative and can vary based on, for example, a building in which the HVACR system is implemented. The terminals 106A-106N can include radiant cooling (e.g., panels or tubing which can be embedded into a building structure); chilled beams (e.g., active or passive); fan-powered terminals (e.g., fan-coils, fan-powered variable air volume (VAV) terminals with sensible cooling coils, or the like); air handlers; process cooling load terminals; heat exchange coils in an airstream; dedicated outdoor HVACR units; as well as suitable combinations thereof.

The terminals 106A-106C include a valve 110A-110C. At least one of the terminals 106A-106N includes a bypass line 108. In the illustrated embodiment, the bypass line 108 is illustrated at the terminal 106N. It is to be appreciated that a plurality of the terminals 106A-106N can include bypass line 108. That is, more than one bypass line 108 can be included in the fluid circuit 100. Any terminal such as the terminal 106N which has the bypass line 108 includes the valve 112 instead of the valve 110A-110D. The bypass line 108 enables at least a portion of the process fluid to bypass the terminal 106N when the bypass flow is enabled. In the embodiment shown in FIG. 3B, terminal 106D has a bypass line 108 and valve 112.

The terminals 106A-106C and the corresponding valves 110A-110C are selectively actuatable to control a flow of process fluid through the corresponding terminal 106A-106C. The valves 110A-110C can have two states, a flow enabled state and a flow disabled state. In operation, when the terminals 106A-106C require cooling, the corresponding valves 110A-110C can be in the flow enabled state so that the temperature controlled process fluid flows through a heat exchange relationship with the corresponding terminals 106A-106C. When the terminals 106A-106C do not require cooling, the corresponding valves 110A-110C can be in the flow disabled state so that the temperature controlled process fluid does not flow in a heat exchange relationship with the corresponding terminals 106A-106C. It is to be appreciated that the terminals 106A-106C and the corresponding valves 110A-110C are separately controllable. In an embodiment, the valves 110A-110C can be modulating valves having a flow enabled state, a flow disabled state, and at least one partial flow state.

At the location of the bypass line 108, the valve 112 is included. In the illustrated embodiment, the valve 112 is a three-way valve. In an embodiment, two separate valves may be used in place of the valve 112, though that may increase a complexity of the system. The valve 112 includes fluid connections for the bypass line 108 and the primary fluid flow through the terminal 106N and terminal 106D. In an embodiment, a default state of the valve 112 is such that flow through the bypass line 108 is disabled. That is, the valve 112 can be set so that it is generally fluidly closed to bypass line 108.

The flow through the terminal 106N (and terminal 106D) and the flow through the bypass line 108 can be independently controlled. That is, flow through the terminal 106N and/or 106D can be modulated to meet a cooling demand regardless of the state of the flow through the bypass line 108. Similarly, flow through the bypass line 108 can be controlled to meet a minimum flowrate threshold regardless of the state of flow through the terminal 106N and/or 106D.

The valve 112 is selectively modifiable based on an operating condition (e.g., a flowrate of the process fluid, a cooling requirement, combinations thereof, or the like). For example, the valve 112 can be selectively enabled or disabled so that process fluid is selectively provided to the terminal 106N (and terminal 106D) according to a cooling requirement. The valve 112 can also be selectively enabled or disabled so that the process fluid selectively bypasses the terminal 106N and/or 106D via the bypass line 108. In an embodiment in which the valve 112 enables flow through the bypass line 108, the flow can be enabled through the terminal 106N and/or 106D as well as through the bypass line 108.

In an embodiment, the valve 112 and bypass line 108 can be included on one or more of the remaining terminals 106A-106C. In such an embodiment, the corresponding valve 110A-110C would be replaced with the valve 112. In the illustrated embodiment, the valves 110A-110C and the valve 112 are disposed on a downstream side of the terminals 106A-106N. It is to be appreciated that the valves 110A-110C and the valve 112 can alternatively be placed on an upstream side of the terminals 106A-106N, according to an embodiment.

In an embodiment, the bypass line 108 may need to be added to the fluid circuit 100B. That is, the bypass line 108 can be retrofit into an existing fluid circuit to provide the capability of maintaining the flowrate of the process fluid above the minimum flowrate threshold. In an embodiment, the bypass line 108 and a valve may be present in the fluid circuit 100B when completing the retrofitting of the fluid circuit 100B. However, in such embodiments, the valve may need to be replaced with the valve 112 as described in this Specification.

The HVACR units 102 include valves 114. The valves 114 can be selectively controlled to enable or disable fluid flow from the corresponding HVACR unit 102. In an embodiment, this control can be based on a cooling load requirement, an operating state of the HVACR units 102, or the like.

The fluid circuit 100B can include a sensor 116 for monitoring a flowrate of the fluid in the fluid circuit 100B. In an embodiment, the sensor 116 is a flowmeter.

In an embodiment, the sensor 116 is optional and may not be included in the fluid circuit 100B. In such an embodiment, an alternative way to determine a flowrate of the process fluid can use differential pressure sensors 118.

It is to be appreciated that the sensor 116 and/or the differential pressure sensors 118 can be included to determine the flowrate of the process fluid. Accordingly, when the sensor 116 is present, the differential pressure sensors 118 may not be present in an embodiment.

Alternatively, when the differential pressure sensors 118 are present, the sensor 116 may not be present in an embodiment.

The sensor 116 and/or the differential pressure sensors 118 are electrically connected to the controller 120. The valve 112 is also electrically connected to the controller 120.

In operation, the controller 120 can receive values from the sensor 116 and/or the differential pressure sensors 118. The controller 120 can selectively control a state (e.g., flow enabled, flow disabled, partial flow, or the like) of the valve 112 based on the values received. In an embodiment, the differential pressure sensor 118 can be integral to the HVACR unit 102. In an embodiment, the differential pressure sensor 118 may be separate from the HVACR unit 102.

For example, when the sensor 116 is included in the fluid circuit 100B, the controller 120 can determine whether the flowrate as received from the sensor 116 is below a minimum flowrate threshold and take action accordingly.

In an embodiment in which the sensor 116 is not included, the controller 120 can utilize the differential pressures received from the differential pressure sensors 118 to calculate a corresponding flowrate. Then, if at least one of the flowrates determined is below a minimum flowrate threshold, the controller 120 can take action accordingly. That is, if the flowrate of either HVACR unit 102 is below the minimum flowrate threshold, then flow through the bypass line 108 can be enabled.

The controller 120 can be representative of the controller 20 for the HVACR unit 102 (FIG. 1). In an embodiment, the controller 120 can be any controller within the HVACR system such as, but not limited to, the chiller controller 20, a controller for a building automation system for the HVACR system, a unit controller corresponding to the terminals 106A-106N, or the like. The controller 120 can be any controller within the HVACR system that is electrically connected to the chillers 102; is electrically connected to the sensor 116 and/or the differential pressure sensors 118A, 118B; and that is electrically connected to the valve 112.

Figure 4:
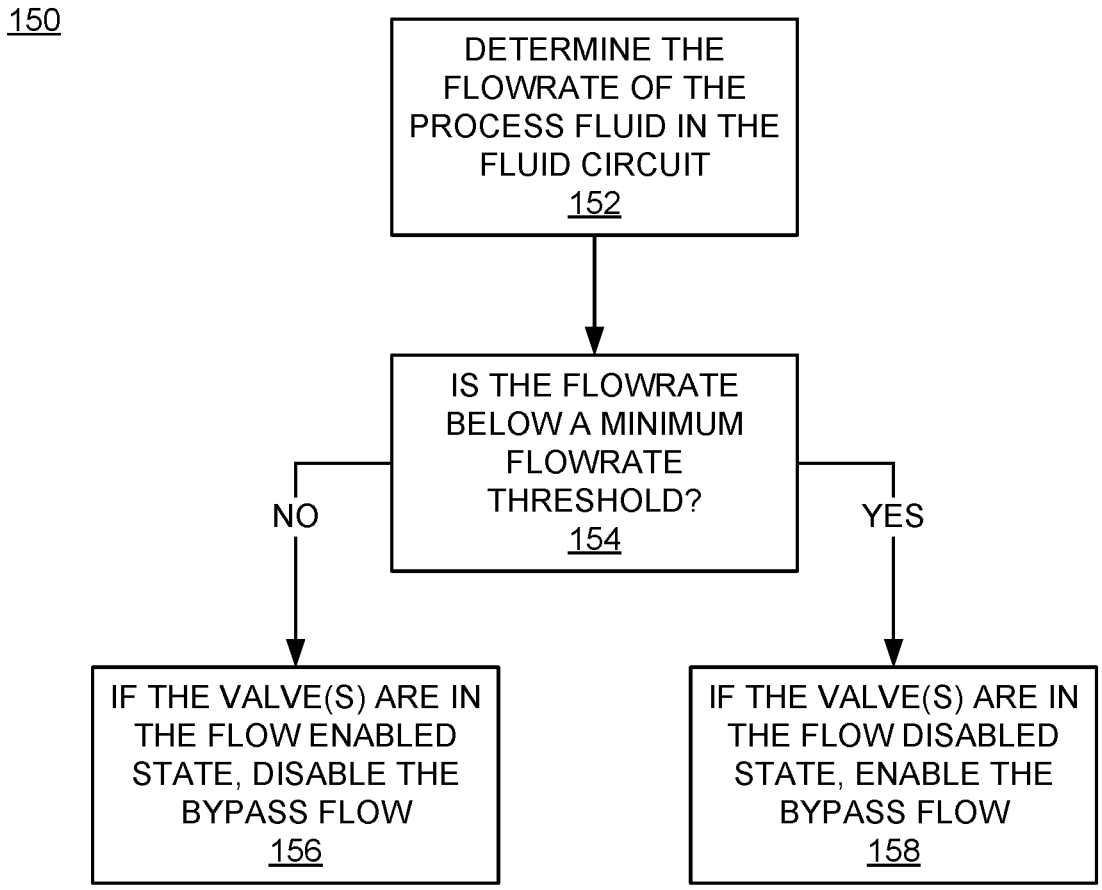
FIG. 4 is a flowchart of a method for controlling a flowrate of a process fluid in a fluid circuit of a heating, ventilation, air conditioning, and refrigeration (HVACR) system, according to an embodiment.

FIG. 4 is a flowchart of a method 150 for controlling a flowrate of a process fluid in a fluid circuit (e.g., the fluid circuit 100A of FIG. 3A or the fluid circuit 100B of FIG. 3B) of an HVACR system, according to an embodiment. The method 150 can be performed by the controller 120 (e.g., FIG. 3) to selectively control a state (e.g., flow enabled, flow disabled, or the like) of a valve (e.g., the valve 112 in FIG. 3) fluidly connected to a bypass line (e.g., bypass line 108 in FIG. 3) to maintain a flowrate of the process fluid in the fluid circuit (e.g., the fluid circuit 100) that is greater than a minimum flowrate.

At 152, the controller 120 determines a flowrate of the process fluid in the fluid circuit 100. The flowrate can be determined by the controller 120 via a flowrate sensor (e.g., the sensor 116 in FIG. 3) such as a flowmeter in an embodiment. In an embodiment, the flowrate can be determined by the controller 120 via a differential pressure sensor (e.g., the differential pressure sensor 118A or 118B).

At 154, the controller 120 compares the flowrate as determined at 152 to a minimum flowrate threshold. The minimum flowrate threshold can be, for example, a minimum flowrate that is recommended by a manufacturer of the HVACR unit 102. In an embodiment including more than one chiller, the flowrate may be compared to a minimum flowrate threshold corresponding to each chiller. It will be appreciated that the minimum flowrate threshold for each chiller can be the same, according to an embodiment.

If, at 154, the flowrate is greater than the minimum flowrate threshold, the controller 120 determines a state of one or more valves 112 to determine whether the valves 112 are in a flow enabled or a flow disabled state at 156. If the valves 112 are in the flow enabled state, the controller 120 switches at least one of the one or more valves 112 to the flow disabled state. After changing the state of the one or more valves 112, the controller 120 continues to determine the flowrate of the process fluid.

If, at 154, the flowrate is below the minimum flowrate threshold, the controller 120 enables a flow of the process fluid through the bypass line at 158. In an embodiment, the controller 120 may switch all of the one or more valves 112 to the flow enabled state. After changing the state of the one or more valves 112, the controller 120 continues to determine the flowrate of the process fluid. In an embodiment that includes a plurality of valves 112, the controller 120 can either place all of the valves 112 in the flow enabled state in response to the flowrate falling below the minimum flowrate threshold, or the controller 120 can enable one of the plurality of valves 112 at a time, checking the minimum flowrate after each modulation, to increase the flowrate of the process fluid.

In an embodiment, the method 150 can additionally include a timer. In such an embodiment, the timer may be initiated when the valve 112 changes state and may need to be completed before the valve 112 changes state again. This can, for example, prevent the valve 112 from changing states too quickly.

ASPECTS

It is noted that any of aspects 1-9 can be combined with any one of aspects 10-13 or 14-18. Any of aspects 10-13 can be combined with any of aspects 14-18.

Aspect 1. A method of controlling an HVACR unit in a heating, ventilation, air conditioning, and refrigeration (HVACR) system that includes an HVACR unit through which a process fluid can be pumped to meet a temperature control demand, comprising: monitoring, by a controller, a flowrate of the process fluid through the HVACR unit; in response to the monitoring: when the flowrate of the process fluid is greater than a minimum flowrate threshold, providing the process fluid to one or more terminals in the HVACR system via the HVACR unit according to the temperature control demand, and disabling a bypass flow of the process fluid through a bypass line by changing a state of a valve fluidly connected to the bypass line and one of the one or more terminals to a flow disabled state; when the flowrate of the process fluid is below the minimum flowrate threshold, enabling, by the controller, the bypass flow of the process fluid through the bypass line by changing the state of the valve fluidly connected to the bypass line and the one of the one or more terminals to a flow enabled state.

Aspect 2. The method of aspect 1, wherein monitoring the flowrate of the process fluid through the HVACR unit includes monitoring at least one of a flow sensor and a differential pressure sensor.

Aspect 3. The method of one of aspects 1 or 2, wherein the HVACR system includes a second HVACR unit through which the process fluid can be pumped to meet the temperature control demand, the method further comprising, monitoring a second flowrate of the process fluid through the second HVACR unit.

Aspect 4. The method of aspect 3, wherein monitoring the second flowrate of the process fluid includes monitoring at least one of a flow sensor and a plurality of differential pressure sensors, each of the plurality of differential pressure sensors corresponding to the HVACR unit and the second HVACR unit.

Aspect 5. The method of one of aspects 3 or 4, wherein the flowrate and the second flowrate are the same.

Aspect 6. The method of one of aspects 3-5, wherein enabling, by the controller, the bypass flow of the process fluid through the bypass line by changing the state of the valve fluidly connected to the bypass line and the one of the one or more terminals to a flow enabled state is in response to the flowrate being below the minimum flowrate threshold or in response to the second flowrate being below the minimum flowrate threshold.

Aspect 7. The method of aspect 6, wherein the minimum flowrate threshold includes a first minimum flowrate threshold for the HVACR unit and a second minimum flowrate threshold for the second HVACR unit that is different from the first minimum flowrate threshold, enabling, by the controller, the bypass flow of the process fluid through the bypass line by changing the state of the valve fluidly connected to the bypass line and the one of the one or more terminals to a flow enabled state is in response to the flowrate being lower than the first minimum flowrate threshold or the second minimum flowrate threshold, or enabling, by the controller, the bypass flow of the process fluid through the bypass line by changing the state of the valve fluidly connected to the bypass line and the one of the one or more terminals to a flow enabled state is in response to the second flowrate being lower than the first minimum flowrate threshold or the second minimum flowrate threshold.

Aspect 8. The method of one of aspects 1-7, wherein the HVACR system includes a plurality of terminals, and enabling, by the controller, the bypass flow of the process fluid through the bypass line by changing the state of the valve fluidly connected to the bypass line and the one of the one or more terminals to a flow enabled state includes changing the state of a plurality of valves fluidly connected to the plurality of terminals and a plurality of bypass lines.

Aspect 9. The method of one of aspects 1-8, wherein the valve is a three-way valve.

Aspect 10. A fluid circuit for a heating, ventilation, air conditioning, and refrigeration (HVACR) system, comprising: an HVACR unit; a variable flowrate pump; a plurality of terminals; one of the plurality of terminals including a bypass line, wherein a portion of a fluid in the fluid circuit flowing through the bypass line bypasses the one of the plurality of terminals; the one of the plurality of terminals including the bypass line having a valve fluidly connected to the one of the plurality of terminals and fluidly connected to the bypass line, wherein a flow control state of the fluid through the bypass line is selectively controlled to maintain a minimum flowrate of the process fluid through the HVACR unit; and a controller configured to monitor a flowrate of the process fluid in the fluid circuit and to control the flow control state of the bypass line.

Aspect 11. The fluid circuit of aspect 10, wherein a plurality of the plurality of terminals each include the bypass line, each bypass line having the valve fluidly connected to a respective terminal.

Aspect 12. The fluid circuit of one of aspects 10 or 11, wherein the valve is a three-way valve including an inlet downstream of the terminal, an inlet from the bypass line, and an outlet, and a flow through the terminal is separately controllable from a flow through the bypass line.

Aspect 13. The fluid circuit of one of aspects 10-12, wherein a flow through the bypass line is independently actuatable relative to a flow through the terminal.

Aspect 14. A fluid circuit for circulating a process fluid in a heating, ventilation, air conditioning, and refrigeration (HVACR) system, comprising: a plurality of HVACR units, including: a first HVACR unit having a first minimum flowrate threshold; a second HVACR unit having a second minimum flowrate threshold; a first variable flowrate pump; a second variable flowrate pump; a plurality of terminals for providing temperature control to a conditioned space within the HVACR system, one of the plurality of terminals including a bypass line, wherein a portion of the process fluid in the fluid circuit flowing through the bypass line bypasses the one of the plurality of terminals; the one of the plurality of terminals including the bypass line having a valve fluidly connected to the one of the plurality of terminals and fluidly connected to the bypass line, wherein a flow control state of the fluid through the bypass line is selectively controlled to maintain a minimum flowrate of the process fluid through the first HVACR unit or the second HVACR unit; and a controller configured to monitor a flowrate of the process fluid in the fluid circuit and to control the flow control state of the bypass line.

Aspect 15. The fluid circuit of aspect 14, wherein a second of the plurality of terminals includes a second bypass line.

Aspect 16. The fluid circuit of one of aspects 14 or 15, wherein the valve is defaulted into a state in which flow through the bypass line is disabled.

Aspect 17. The fluid circuit of one of aspects 14-16, wherein the controller is configured to selectively enable flow through the bypass line by changing the valve to a flow enabled state in which flow through the bypass line is enabled in response to the flowrate as monitored being below a minimum flowrate threshold.

Aspect 18. The fluid circuit of aspect 17, wherein the minimum flowrate threshold is a relatively lower of the first minimum flowrate threshold and the second minimum flowrate threshold.

The terminology used in this Specification is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This Specification and the embodiments described are exemplary only, with the true scope and spirit of the disclosure being indicated by the claims that follow.

What is claimed is:

1. A method of controlling a heating, ventilation, air conditioning, and refrigeration (HVACR) unit in an HVACR system that includes the HVACR unit through which a process fluid can be pumped to meet a temperature control demand, comprising:

monitoring, by a controller, a flowrate of the process fluid through the HVACR unit;

in response to the monitoring:

when the flowrate of the process fluid is greater than a minimum flowrate threshold, providing the process fluid to one or more terminals in the HVACR system via the HVACR unit according to the temperature control demand, and disabling a bypass flow of the process fluid through a bypass line configured to bypass a selected terminal of the plurality of terminals by changing a state of a valve fluidly connected to the bypass line and the selected terminal to a flow disabled state;

when the flowrate of the process fluid is below the minimum flowrate threshold, enabling, by the controller, the bypass flow of the process fluid through the bypass line by changing the state of the valve fluidly connected to the bypass line and to the selected terminal to a flow enabled state, and when the changing of the state of the valve is performed, initiating a timer, wherein the timer completes before the state of the valve can be changed again.

2. The method of claim 1, wherein monitoring the flowrate of the process fluid through the HVACR unit includes monitoring at least one of a flow sensor and a differential pressure sensor.

3. The method of claim 1, wherein the HVACR system includes a second HVACR unit through which the process fluid can be pumped to meet the temperature control demand, the method further comprising, monitoring a second flowrate of the process fluid through the second HVACR unit.

4. The method of claim 3, wherein monitoring the second flowrate of the process fluid includes monitoring at least one of a flow sensor and a plurality of differential pressure sensors, each of the plurality of differential pressure sensors corresponding to the first and second HVACR units.

5. The method of claim 3, wherein the flowrate and the second flowrate are the same.

6. The method of claim 3, wherein enabling, by the controller, the bypass flow of the process fluid through the bypass line by changing the state of the valve fluidly connected to the bypass line and the selected terminal to a flow enabled state is in response to the flowrate being below the minimum flowrate threshold or in response to the second flowrate being below the minimum flowrate threshold.

7. The method of claim 6, wherein the minimum flowrate threshold includes a first minimum flowrate threshold for the HVACR unit and a second minimum flowrate threshold for the second HVACR unit that is different from the first minimum flowrate threshold, enabling, by the controller, the bypass flow of the process fluid through the bypass line by changing the state of the valve fluidly connected to the bypass line and the selected terminal to a flow enabled state is in response to the flowrate being lower than the first minimum flowrate threshold or the second minimum flowrate threshold, or enabling, by the controller, the bypass flow of the process fluid through the bypass line by changing the state of the valve fluidly connected to the bypass line and the selected terminal to a flow enabled state is in response to the second flowrate being lower than the first minimum flowrate threshold or the second minimum flowrate threshold.

8. The method of claim 1, wherein changing the state of the valve fluidly connected to the bypass line and the selected terminal to a flow enabled state includes changing the state of a plurality of valves fluidly connected to the plurality of terminals and a plurality of bypass lines.

9. The method of claim 1, wherein the valve is a three-way valve.

* * * * *